US009247587B2

(12) United States Patent
Kim et al.

(10) Patent No.: US 9,247,587 B2
(45) Date of Patent: Jan. 26, 2016

(54) HEATING ELEMENT AND A MANUFACTURING METHOD THEREOF

(75) Inventors: Ki-Hwan Kim, Daejeon (KR); Young-Jun Hong, Daejeon (KR); Hyeon Choi, Daejeon (KR); Su-jin Kim, Daejeon (KR)

(73) Assignee: LG CHEM, LTD., Seoul (KR)

( * ) Notice: Subject to any disclaimer, the term of this patent is extended or adjusted under 35 U.S.C. 154(b) by 0 days.

(21) Appl. No.: 13/821,810

(22) PCT Filed: Sep. 14, 2011

(86) PCT No.: PCT/KR2011/006774

§ 371 (c)(1),
(2), (4) Date: Mar. 8, 2013

(87) PCT Pub. No.: WO2012/036459

PCT Pub. Date: Mar. 22, 2012

(65) Prior Publication Data

US 2013/0175255 A1 Jul. 11, 2013

(30) Foreign Application Priority Data

Sep. 14, 2010 (KR) ..... 10-2010-0090150
Sep. 14, 2011 (KR) ..... 10-2011-0092413

(51) Int. Cl.

| | |
|---|---|
| ***H05B 3/28*** | (2006.01) |
| ***H05B 3/86*** | (2006.01) |
| ***H05B 3/84*** | (2006.01) |
| ***H01C 17/00*** | (2006.01) |

(52) U.S. Cl.

CPC ..... *H05B 3/84* (2013.01); *H01C 17/00* (2013.01); *H05B 2203/005* (2013.01); *H05B 2203/011* (2013.01); *Y10T 29/49083* (2015.01)

(58) Field of Classification Search

CPC ..... H05B 3/10; H05B 3/18; H05B 3/26; H05B 3/28; H05B 3/283; H05B 3/286; H05B 3/84; H05B 3/86; H05B 2203/002; H05B 2203/011; H05B 2203/031; H05B 2214/02

See application file for complete search history.

(56) References Cited

U.S. PATENT DOCUMENTS

| | | | | | |
|---|---|---|---|---|---|
| 4,002,883 | A | * | 1/1977 | Hurko | 219/543 |
| 4,063,247 | A | * | 12/1977 | Sakurai et al. | 343/704 |
| 4,608,570 | A | * | 8/1986 | Inaba et al. | 343/704 |
| 4,673,609 | A | * | 6/1987 | Hill | 428/187 |
| 4,803,492 | A | * | 2/1989 | Inaba et al. | 343/713 |
| 4,954,797 | A | * | 9/1990 | Shinnai et al. | 343/704 |

(Continued)

FOREIGN PATENT DOCUMENTS

| | | | |
|---|---|---|---|
| CN | 1522553 | A | 8/2004 |
| CN | 101131492 | A | 2/2008 |

(Continued)

OTHER PUBLICATIONS

Korean Office Action dated Jan. 2, 2013.

*Primary Examiner* — Joseph M Pelham
(74) *Attorney, Agent, or Firm* — Dentons US LLP

(57) ABSTRACT

The present invention relates to a heating element including a transparent substrate, a bus bar, a power supply connected to the bus bar, a heat emitting pattern line provided on the transparent substrate and electrically connected to the bus bar, and a non-heat emitting pattern line provided on the transparent substrate and not electrically connected to the bus bar, and a method for manufacturing the same.

8 Claims, 4 Drawing Sheets

(56) References Cited

U.S. PATENT DOCUMENTS

| | | | | |
|---|---|---|---|---|
| 5,119,106 | A * | 6/1992 | Murakami | 343/713 |
| 5,239,303 | A * | 8/1993 | Hirotsu et al. | 343/713 |
| 5,936,585 | A * | 8/1999 | Hall | 343/713 |
| 7,411,158 | B2 * | 8/2008 | Andrt | 219/203 |
| 7,880,120 | B2 * | 2/2011 | Schmidt et al. | 219/203 |
| 8,431,871 | B2 * | 4/2013 | Schmidt et al. | 219/203 |
| 8,471,177 | B2 * | 6/2013 | Chaussade et al. | 219/203 |
| 2004/0159645 | A1 | 8/2004 | Gillner et al. | |
| 2007/0108175 | A1 * | 5/2007 | Andrt | 219/203 |
| 2007/0187391 | A1 * | 8/2007 | Weiss et al. | 219/522 |
| 2007/0221646 | A1 | 9/2007 | Shin et al. | |
| 2007/0278210 | A1 | 12/2007 | Weiss | |
| 2009/0218854 | A1 | 9/2009 | Phahler et al. | |
| 2010/0038352 | A1 * | 2/2010 | Byers et al. | 219/202 |
| 2010/0252545 | A1 * | 10/2010 | Weiss et al. | 219/203 |
| 2011/0017719 | A1 * | 1/2011 | Choi et al. | 219/260 |
| 2011/0017726 | A1 | 1/2011 | Choi et al. | |
| 2011/0017727 | A1 | 1/2011 | Choi et al. | |
| 2011/0042370 | A1 | 2/2011 | Choi et al. | |
| 2011/0062139 | A1 * | 3/2011 | Schmidt et al. | 219/203 |
| 2011/0233182 | A1 * | 9/2011 | Baranski | 219/203 |
| 2012/0261404 | A1 * | 10/2012 | Choi et al. | 219/522 |
| 2013/0020303 | A1 * | 1/2013 | Kim et al. | 219/203 |
| 2013/0153559 | A1 * | 6/2013 | Choi et al. | 219/203 |
| 2013/0292373 | A1 * | 11/2013 | Choi et al. | 219/522 |
| 2014/0083991 | A1 * | 3/2014 | Choi et al. | 219/203 |
| 2014/0117003 | A1 * | 5/2014 | Choi et al. | 219/203 |

FOREIGN PATENT DOCUMENTS

| | | | |
|---|---|---|---|
| JP | 2007-324123 | A | 12/2007 |
| JP | 2009-513201 | A | 4/2009 |
| KR | 10-1998-0066158 | A | 10/1998 |
| KR | 10-2007-0096407 | A | 10/2007 |
| KR | 10-2009-0099502 | A | 9/2009 |
| KR | 10-2009-0129927 | A | 12/2009 |
| WO | 2009/151203 | A1 | 12/2009 |

* cited by examiner

HEATING ELEMENT AND A MANUFACTURING METHOD THEREOF

The application is a national stage application of PCT/KR2011/006774, filed on Sep. 14, 2011, which claims priority from Korean Patent Application Nos. 10-2010-0090150 and 10-2011-0092413, filed on Sep. 14, 2010 and Sep. 14, 2011, respectively, all of which are incorporated herein in their entirety by reference.

TECHNICAL FIELD

The present invention relates to a heating element and a method for manufacturing the same. More particularly, the present invention relates to a heating element in which heat emitting occurs uniformly and a field of vision is not obstructed, and a method for manufacturing the same.

BACKGROUND ART

During winter or on a rainy day, frost is formed on a glass surface of a vehicle because of a difference between temperatures of the outside and inside of the vehicle. In addition, in the case of an indoor ski resort, a dew condensation phenomenon occurs because of a difference between temperatures of the inside where there is a slope and the outside of the slope. Heat emitting glass has been developed in order to solve the problem. The heat emitting glass is a notion that after a thermal conductive layer or hot wire pattern is formed on a surface of glass, heat is generated by applying electricity, thereby increasing a temperature of the surface of glass.

In particular, it is important for the heat emitting glass for a vehicle to have low resistance in order to generate sufficient heat, and, more importantly, the heat emitting glass should not be unpleasant to the human eyes. Accordingly, a method for manufacturing the heat emitting glass through ITO (Indium Tin Oxide) sputtering has been tried. However, in this case, there is a problem in that heat is not sufficiently emitted.

A hot wire may be used as a method for constituting the heat emitting glass. In this case, if the hot wire is constituted by being arranged in a constant pattern such as a triangular or trapezoidal form according to the form of glass, a portion where a distance between bus bars is changed may be generated.

If the distance between the bus bars is changed, a resistance value of the hot wire is changed according to the distance between the bus bars. Furthermore, a value of a current flowing in each hot wire in the bus bars under a predetermined voltage is changed, such that heat is not uniformly emitted.

As described above, in the case where the distance between the bus bars is changed according to the form of glass, the following two methods are used in order to implement a uniform heat emitting level.

First, there is a method for controlling an emission level of heat provided per area by controlling a thickness of a hot wire and a space between the hot wires. Second, there is a method for implementing uniform heat emitting by disposing all the bus bars of two electrodes at a lower end, and changing a thickness of a hot wire according to a change in length of the hot wires connecting both bus bars.

The above two methods can ensure a predetermined level of a uniform heat emitting property. However, since a distribution of areas occupied by the arranged hot wires, that is, a density of the hot wires per unit area is changed according to the position, it is impossible to implement a uniform pattern arrangement. For example, in the case of glass for a vehicle, when a driver in the vehicle observes the outside through the glass for the vehicle, a recognition property of a hot wire pattern is increased due to a non-uniform distribution of the hot wire pattern, such that there is a problem in that a field of vision of the driver may be obstructed.

DETAILED DESCRIPTION OF THE INVENTION

Technical Problem

The present invention has been made in an effort to provide a heating element including a heat emitting pattern line, in which heat is uniformly emitted regardless of a form of a board on which the heat emitting pattern line is provided, or a change in interval between bus bars and there is no obstruction of a field of vision, and a method for manufacturing the same.

Technical Solution

An exemplary embodiment of the present invention provides a heating element including: a transparent substrate; a bus bar; a power supply connected to the bus bar; a heat emitting pattern line provided on the transparent substrate and electrically connected to the bus bar; and a non-heat emitting pattern line provided on the transparent substrate and not electrically connected to the bus bar.

Another exemplary embodiment of the present invention provides a method for manufacturing a heating element, which includes separately or simultaneously forming a bus bar, a heat emitting pattern line electrically connected to the bus bar, and a non-heat emitting pattern line not electrically connected to the bus bar on a transparent substrate.

Yet another exemplary embodiment of the present invention provides a heating element including: a transparent substrate; a bus bar; a power supply connected to the bus bar; and a heat emitting pattern line provided on the transparent substrate and electrically connected to the bus bar. When an area in which the heat emitting pattern line is provided is divided into two or more partitions, lengths of the heat emitting pattern lines connected to the bus bars in the partitions are the same as each other.

Advantageous Effects

According to exemplary embodiments of the present invention, it is possible to provide a heating element that is constituted by a heat emitting pattern line electrically connected to a bus bar so that heat is uniformly emitted, in which the heating element emits heat uniformly and does not obstruct a field of vision by making a distribution of pattern uniform by using a non-heat emitting pattern line not electrically connected to the bus bar. In addition, in the case where the area in which the heat emitting pattern line is provided is divided into two or more partitions so that when lengths of the heat emitting pattern lines in the partitions are the same as each other, heat is uniformly emitted by the same length of the heat emitting lines in the partitions. On the other hand, a portion of the entire heat emitting area can be intentionally partitioned into a high level of heat emitting area and a low level of heat emitting area by changing an interval between the partitions and the length of the heat emitting line between the partitions.

BEST MODE

Hereinafter, the present invention will be described in detail.

A heating element according to an exemplary embodiment of the present invention includes a transparent substrate, a bus bar, a power supply connected to the bus bar, a heat emitting pattern line provided on the transparent substrate and electrically connected to the bus bar, and a non-heat emitting pattern line provided on the transparent substrate and not electrically connected to the bus bar.

In the exemplary embodiment of the present invention, by using the non-heat emitting pattern line not electrically connected to the bus bar, in the case where distances between the bus bars are not the same as each other, a field of vision may not be hindered by constituting the heat emitting pattern line so that heat emitting is uniform and making the distribution of the entire pattern line uniform.

In the present specification, the electrical connection to the bus bar means a state in which a current flows when a voltage is applied because a pattern line is connected to two independent bus bars that are opposite to each other. In the present specification, for convenience, the pattern line electrically connected to the bus bar is called a heat emitting pattern line. To the contrary, no electrical connection to the bus bar means a state in which a current does not flow when a voltage is applied. In the present specification, for convenience, a pattern line not electrically connected to the bus bar is called a non-heat emitting pattern line.

In the exemplary embodiment of the present invention, it is preferable that the heat emitting pattern line is disposed so that the heat emitting is uniform. Herein, the uniform heat emitting means that a standard deviation of a surface temperature in an entire area in which the heat emitting pattern lines are provided is 20% or less, specifically 15% or less, and more specifically 10% or less.

For the uniform heat emitting as described above, the heat emitting pattern line may be formed by controlling a thickness, interval, height, and form of the heat emitting pattern line according to a position or interval of the bus bar and a geometrical form of the heat emitting area.

Figure 1:
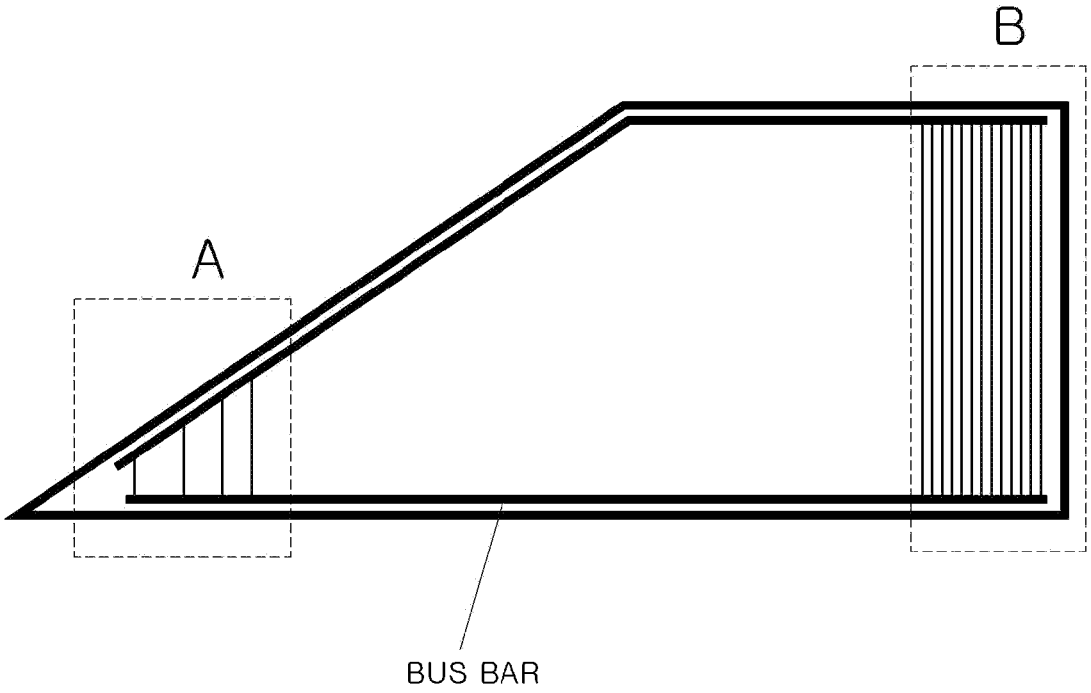
FIG. 1 illustrates a distribution of a heat emitting pattern line for uniform heat emitting.

Under the condition where the thicknesses, heights and forms of the heat emitting pattern lines are the same as each other, the case where the intervals of the heat emitting pattern lines vary is illustrated in FIG. 1. As shown in FIG. 1, a heating value per area may be uniformly controlled by widely setting intervals between the heat emitting pattern lines disposed at a position where the intervals between the bus bars are narrow to be in inverse proportion to the distance between the bus bars. Each pattern line acts as one resistor body in the heating element illustrated in FIG. 1, a voltage applied between both ends of the bus bar in parallel resistance connection is the same as a voltage applied to each resistor body, and a current applied to each resistor body (heat emitting pattern line) changes according to a change of the resistance. If the thicknesses, heights, and materials of the heat emitting pattern lines are the same as each other, resistance of the heat emitting pattern line is in proportion to a length (L) of the heat emitting pattern line connected to the bus bar. If the heat emitting area provided by one heating element is defined by multiplying a length (L) of a resistor and a unit width (W), the heating value per area is represented by the following Equation 1.

$$\frac{V\times I}{L\times W}=\frac{V^2\times(1/R)}{L\times W}=\frac{V^2}{R\times L\times W}=\frac{V^2}{aL\times L\times W} \quad \text{[Equation 1]}$$

Herein, V is a voltage applied between both ends of the bus bar, I is a current applied to the heat emitting pattern line, R is resistance of the heat emitting pattern line, and a is a proportional constant value.

From the relationship Equation 1, when the length of the resistor body (heat emitting pattern line) is changed, the W value should be changed in inverse proportion to a square value of L in order to satisfy the heating value per the same area. An example thereof is shown in FIG. 1. The interval (W) between resistor bodies (heat emitting pattern lines) of area A in which the length (L) between the bus bars is short is wide, and it can be seen that the interval (W) is changed as the length (L) between the bus bars is changed. It can be seen that in area B, since the length (L) between the bus bars is long as compared to area A, the interval (W) is narrow. In area B, since the length between the bus bars is constant, the resistor bodies are disposed at constant intervals (W).

In the heating element as described above, the uniform heat emitting may be satisfied by controlling a physical dimension of the interval (W) between the resistor bodies (heat emitting pattern lines), but a distribution of the resistor bodies is non-uniform. This non-uniformity is well observed by the naked eye because of dense and sparse properties of the distribution of the resistor bodies, such that there is a disadvantage in that a recognition ability of the pattern is increased.

In order to solve the above problems, in the exemplary embodiment of the present invention, a visually uniform distribution may be implemented by additionally inserting the non-heat emitting pattern line not electrically connected thereto.

Figure 2:
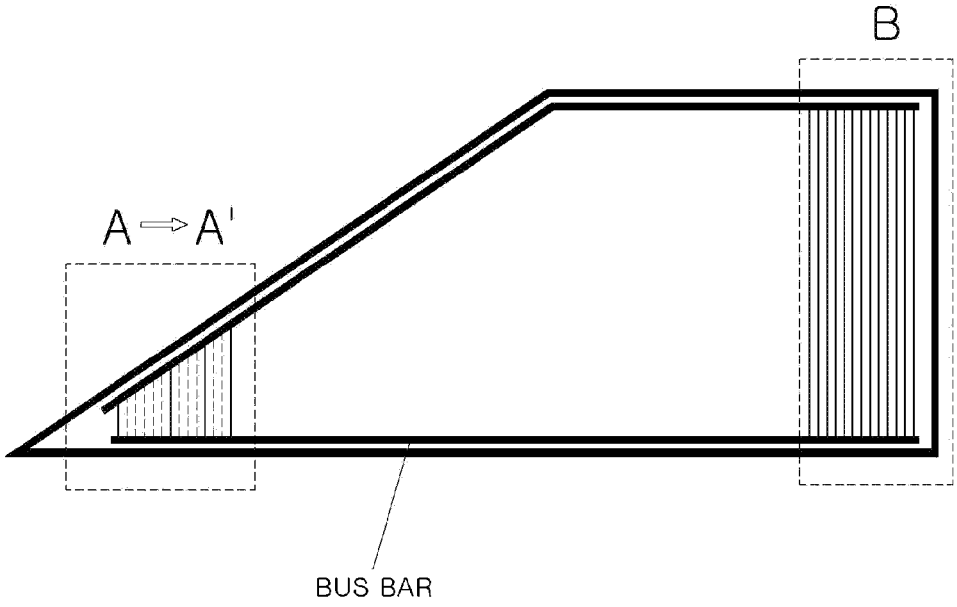
FIG. 2 and FIG. 3 illustrate an exemplary embodiment according to the present invention.

FIG. 2 is an example that illustrates a heating element in which a recognition ability of a pattern is decreased through uniform heat emitting and uniform distribution of the pattern, that is, a concealment property of the pattern is improved by providing the non-heat emitting pattern line according to the exemplary embodiment of the present invention in order to solve the problems of the heating element illustrated in FIG. 1. In FIG. 2, the non-heat emitting pattern line is represented by a dotted line. Herein, the dotted line is differentiated from the heat emitting pattern line represented by a full line, and the form of the real non-heat emitting pattern line is not the dotted line. FIG. 2 illustrates an example in which a pattern having the same interval between the pattern lines as in area B is formed by distributing the non-heat emitting pattern line represented by the dotted line in area A in which the interval between the heat emitting pattern lines is different from that of area B in FIG. 1. In the exemplary embodiment of the present invention, a one-dimensional straight line that is a pattern illustrated in FIG. 1 and FIG. 2 is shown as only an example, and the method provided in the exemplary embodiment of the present invention includes a two-dimensional pattern as well as the one-dimensional pattern.

Figure 3:
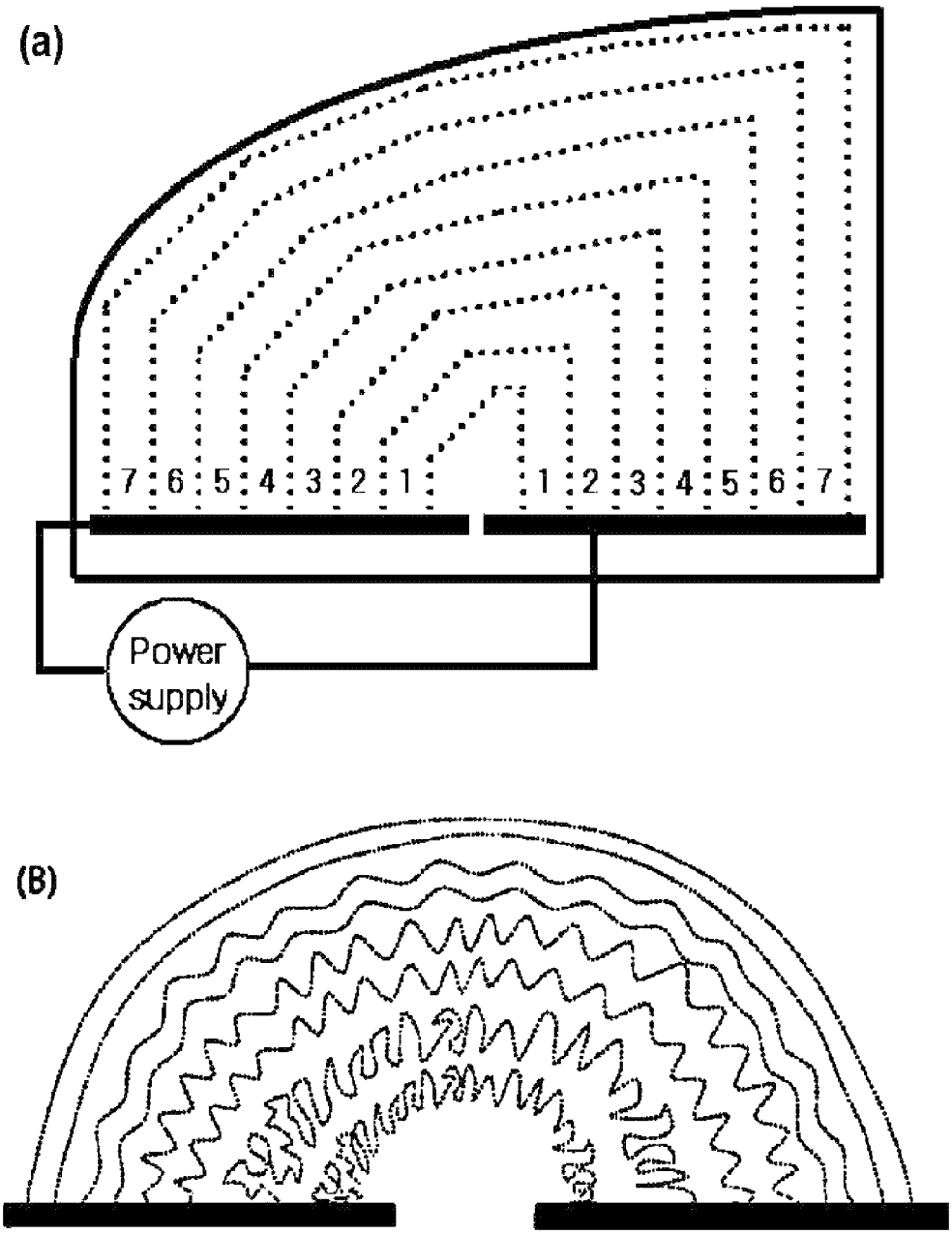

In the exemplary embodiment of the present invention, when the area in which the heat emitting pattern line is provided is divided into two or more partitions (refer to FIG. 3A), the heat emitting pattern lines connected to the bus bars in the partitions may be disposed so that lengths of the heat emitting pattern lines are the same as each other. FIG. 3B illustrates an example in which the heat emitting pattern lines in the partitions are disposed so that the lengths of the heat emitting pattern lines are the same as each other. In the case of the heating element of FIG. 3, the bus bar is disposed at a lower end. In the case where a level of a predetermined heating value or more is set as a purpose, in the case where it is difficult to obtain uniform heat emitting by only using a method for controlling the interval between the lines like FIG. 2 from the standpoint of geometry, the case may be compensated by the constitution like FIG. 3. In this case, after the area is divided into two or more partitions according to the design, a path of the heat emitting pattern line may be disposed so that the line has a predetermined length in the partition. The pattern designs of the heat emitting pattern line overlap according to the disposed path, thus forming the heat emitting pattern.

FIG. 3B illustrates an example in which the heat emitting pattern lines having the same length are formed in the partitions. As illustrated in FIG. 3B, when the distance between the bus bars is short, the path is made winding so that the lengths of the heat emitting pattern lines connecting the bus bars disposed at a lower end are the same as each other.

Figure 4:
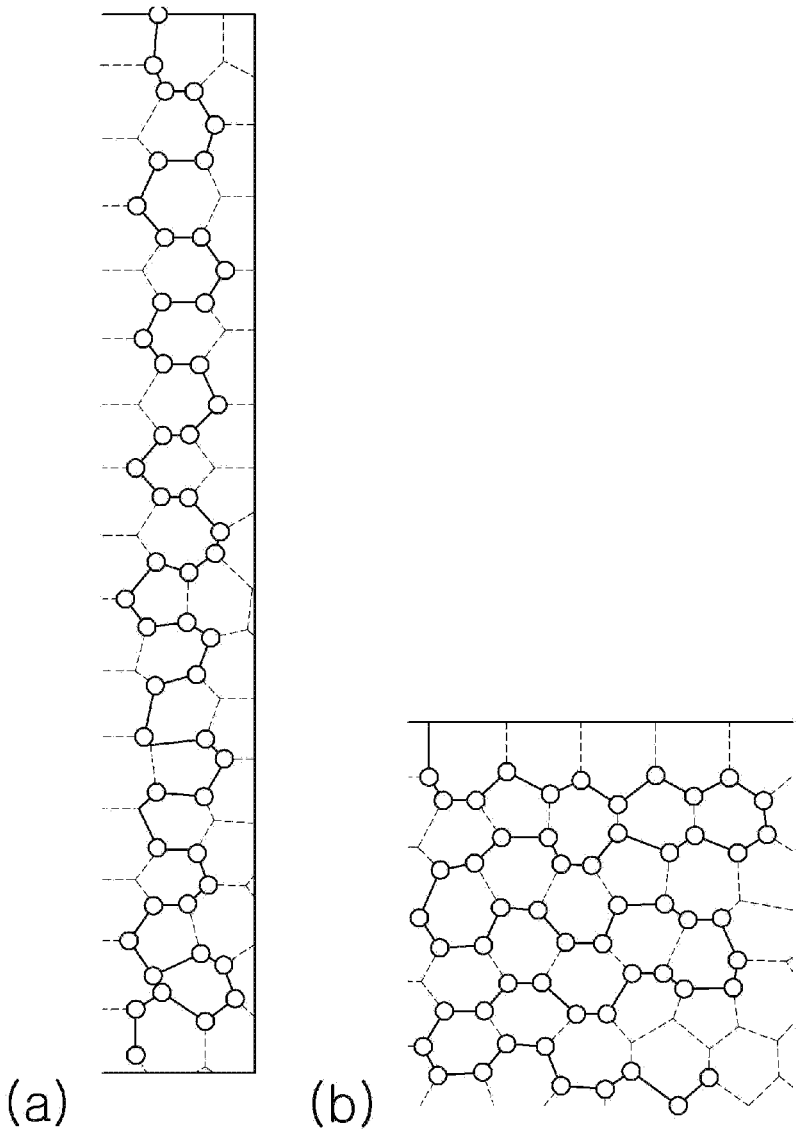
FIG. 4 illustrates a method for forming a pattern of a heating element according to the exemplary embodiment of the present invention.

In the case where the heat emitting pattern line connecting the bus bars as illustrated in FIG. 2 is a straight line path, FIG. 4 illustrates an example in which the lengths of the heat emitting pattern lines having different straight line paths in three ways become the same as each other. In the case where the straight line path of the area of FIG. 4B is shorter than that of the area of FIG. 4A by three times, the same distance level may be obtained by performing designing so that the heat emitting pattern line is made winding in not a length direction but a width direction in three ways as illustrated in FIG. 4B. A portion represented by the full line represents the heat emitting line in which heat is substantially emitted, and the other dotted line represents the non-heat emitting pattern line in which heat is not emitted because there is no electrical connection. Points over patterns (a) and (b) illustrated in FIG. 4 represent apexes through which the heat emitting line passes, and the same length may be ensured by maintaining the same number of apexes in two designs. Through this method, even in the case where two bus bars are disposed on the same line, it is possible to implement visual uniformity by forming uniform heat emitting and the uniform distribution of the pattern. The basic background design of the heat emitting line illustrated in FIG. 4 is performed on the basis of a Voronoi pattern, and the design of the Voronoi pattern will be described below.

In the exemplary embodiment of the present invention, it is preferable that the non-heat emitting pattern line not electrically connected to the bus bar is disposed so that a distribution of the entire pattern including the heat emitting pattern line and non-heat emitting pattern line is uniform. Thereby, even though the distribution of the heat emitting pattern line substantially emitting heat is not uniform, it is possible to prevent obstruction of a field of vision by the pattern line by making the distribution of the entire pattern uniform. For example, it is preferable that the entire pattern including the heat emitting pattern line and non-heat emitting pattern line according to the exemplary embodiment of the present invention has a pattern density so that an opening ratio deviation with respect to any circle having a diameter of 20 cm is 5% or less. Herein, the opening ratio means a ratio of an area that is not covered by the pattern in the area in which the pattern is provided.

The non-heat emitting pattern line may be determinded according to the form of the heat emitting pattern line so that the distribution of the entire pattern is uniform.

As described in the above exemplary embodiment, when the area in which the heat emitting pattern line is provided is divided into two or more partitions, in the case where the heat emitting pattern lines are disposed so that the connection lengths between the heat emitting pattern lines and bus bars are the same as each other in the partitions, the non-heat emitting pattern line may be disposed so that the opening ratio deviation between the partitions of the entire pattern line including the heat emitting pattern line and non-heat emitting pattern line is 5% or less.

In the exemplary embodiment of the present invention, the transparent substrate is not particularly limited, but it is preferable to use the board where light transmittance is 50% or more, and preferably 75% or more. In detail, glass may be used as the transparent substrate, and the plastic board or plastic film may be used. In the case where the plastic film is used, it is preferable that after the heat emitting pattern line and non-heat emitting pattern line are formed, a glass substrate or a plastic substrate is attached to at least one side of the board. In this case, it is more preferable that the glass substrate or plastic substrate is attached to the side on which the heat emitting pattern line and non-heat emitting pattern line of the transparent substrate are formed. A material that is known in the art may be used as the plastic substrate or film, and for example, it is preferable to use the film that has the visible light transmittance of 80% or more such as PET (Polyethylene terephthalate), PVB (polyvinylbutyral), PEN (polyethylene naphthalate), PES (polyethersulfon), PC (polycarbonate), and acetyl celluloide. The thickness of the plastic film is preferably 12.5 to 500 μm, and more preferably, 30 to 150 μm.

In the exemplary embodiment of the present invention, the heat emitting pattern line or non-heat emitting pattern line may be formed by using first, a method including performing direct printing on the transparent substrate and performing drying or baking, second, a method including laminating a metal thin film on the transparent substrate and patterning the metal thin film, and, third, a method including forming a silver pattern by using a photograph manner on the transparent substrate coated a silver salt and increasing a thickness of a hot wire until desired sheet resistance is obtained through plating.

A method for forming a pattern line as described below may be applied to the heat emitting pattern line and non-heat emitting pattern line.

The line width of the pattern line is 100 μm or less, and preferably 0.1 μm to 30

The interval between the pattern lines may be 50 μm to 30 mm. Herein, the interval between the pattern lines may be an interval between the heat emitting pattern lines, or an interval between the heat emitting pattern line and non-heat emitting pattern line.

The height of the pattern line may be 0.2 to 100 Preferably, the height is about 10 μm.

The case where the pattern line is within the above numerical range is advantageous for obtaining sufficient heat emitting performance.

The pattern line may have a stripe, diamond, square lattice, or circle form, but is not limited thereto.

In the case where the printing method that is the first method among the above methods is used, a paste including a thermal conductive material may be printed on the transparent substrate by using the printing method. In the case where the printing method is used, a cost is relatively low, a manufacturing process is simple, a line width is small, and a precise pattern line may be formed.

The printing method is not particularly limited, and a printing method such as offset printing, screen printing, and gravure printing may be used. For example, the offset printing may be performed by using the method in which after the paste is filled in the cliche on which the pattern is formed, first transferring is performed by using silicon rubber that is called the blanket, and the second transferring is performed by closely contacting the blanket and glass, but is not limited thereto.

Because of the release property of the blanket, most of the paste is transferred on glass, and as a result, a separate blanket washing process is not required. The cliche may be manufactured by precisely etching the soda lime glass on which the desired pattern line is formed, and metal or DLC (diamond-like carbon) coating may be performed on the glass surface for the durability. The cliche may be manufactured by etching the metal plate.

In the exemplary embodiment of the present invention, in order to implement the more precise pattern line, it is most preferable to use the offset printing method.

As the thermal conductive material, metal having excellent thermal conductivity is preferably used, copper and silver may be used, and silver is most preferable. In the exemplary embodiment of the present invention, the thermal conductive material may be used in a particle form.

The paste may further include an organic binder in addition to the above thermal conductive material so that the printing process is easily performed. It is preferable that the organic binder has a volatile property in the baking process. In addition, in order to improve the attachment ability of the paste to the glass, the paste may further include a glass frit. If necessary, a solvent may be further added.

The paste may be printed so that the line width of the print pattern line after the baking is 100 μm or less, and preferably 0.1 μm to 30 μm or less, may be printed so that the interval between lines of the print patterns after the baking is 50 μm to 30 mm, and may be printed so that the height of the line from the surface of the transparent substrate is 0.2 to 100 μm.

In the print pattern, the opening ratio, that is, a ratio of the transparent substrate area that is not covered by the print pattern is preferably 65% or more and more preferably 90% or more.

The pattern line may be a grid type pattern in which a line width is 20 rim, and an interval between the lines is 280 μm as an example.

If the above paste is printed in a predetermined pattern on the transparent substrate by using the printing method and baked, a pattern having thermal conductivity is formed. In this case, a baking temperature is not particularly limited, but may be 400 to 700° C., and preferably 500 to 650° C. In the case where the plastic film or plastic substrate is used as the transparent substrate, a low temperature baking may be performed at a low temperature, for example, 150 to 350° C.

In the case where the lamination method that is the second method among the methods for forming the pattern line is used, the laminated metal thin films may be patterned by patterning an etching resistant film by using the photolithography or printing method and then performing metal etching.

As the printing method, a reverse offset printing method or a gravure offset method which can print a line having a width of 5 to 100 μm may be used. The etching resistance layer may use novolac-based, acryl-based, and silicon-based materials, but is not limited thereto. When the photolithography is used, the etching resistance layer pattern may be formed by using a photoresist material, and in particular, a dry film resist may be used in order to apply it to a roll process.

The etching resistance layer pattern is advantageously irregular in order to minimize diffraction/interference by a single light source, but it is preferable that the pattern has a pattern density having transmittance deviation of 5% or less in respects to a predetermined circle that has a diameter of 20 cm. In addition, in the case of the regular pattern such as a wave pattern, it is preferable that an interval between the lines forming the pattern is 2 mm or more.

The metal thin film is etched by dipping the transparent substrate having the metal thin film provided with the etching resistance layer into the etching solution. An acidic solution may be used as the etching solution. As the acidic solution, a strong acid such as a hydrochloric acid, a nitric acid, a sulfuric acid, and a phosphoric acid, and an organic acid such as a formic acid, a butyric acid, a lactic acid, a sorbic acid, a fumaric acid, a malic acid, a tartaric acid, and a citric acid may be used, and hydrogen peroxide and other additives may be further added to the solution.

After the board that is provided with the pattern line obtained through the above process is cut to have a size of 10 cm×10 cm, when the resistance is measured by forming an electrode (bus bar) line on one side thereof, it is preferable that it has 1 ohm or less, and preferably 0.35 ohm. In this case, the obtained resistance value has the same meaning as the sheet resistance.

In the exemplary embodiment of the present invention, the heat emitting pattern line or non-heat emitting pattern line may be straight lines, or various modifications such as curved lines, wave lines, and zigzag lines may be possible.

In the exemplary embodiment of the present invention, the ratio of the distribution of the area of the entire pattern including the heat emitting pattern line and non-heat emitting pattern line is 35% or less, and preferably 10% or less.

In the exemplary embodiment of the present invention, the entire pattern including the heat emitting pattern line and non-heat emitting pattern line, as illustrated in FIG. 4, may be a boundary form of figures constituting the Voronoi diagram.

Figure 5:
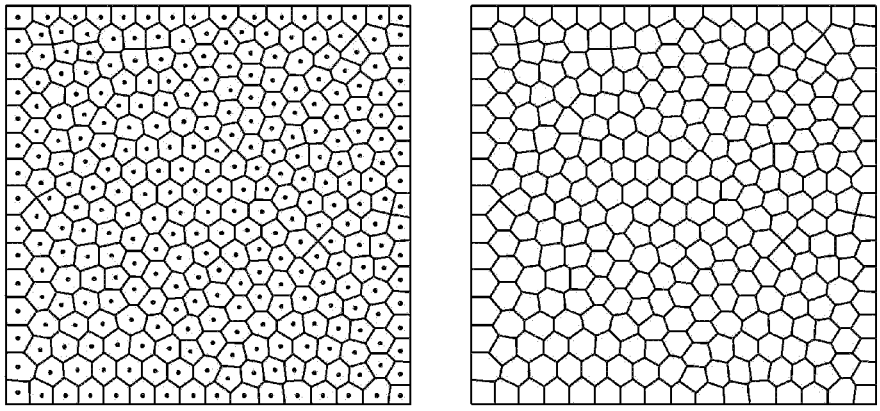
FIG. 5 and FIG. 6 illustrate a procedure for forming a pattern on a heating element according to the exemplary embodiments of the present invention.

The distribution of the entire pattern may be made uniform by forming the entire pattern in the boundary form of the figures that form the Voronoi diagram, such that the side effects by diffraction and interference of light may be minimized. The Voronoi diagram is a pattern that is formed by filling the closest area to the corresponding dot as compared to the distance of each dot from the other dots if Voronoi diagram generator dots are disposed in a desired area to be filled. For example, when large discount stores in the whole country are represented by dots and consumers try to find the closest large discount store, the pattern that displays the commercial area of each discount store may be exemplified. That is, if the space is filled with a regular hexagon and each dot of the regular hexagon is set by the Voronoi generator, a honeycomb structure may be the pattern. In the exemplary embodiment of the present invention, in the case where the pattern is formed by using the Voronoi diagram generator, there is an advantage in that the complex pattern form that can minimize the side effects by the diffraction and interference of light can be easily determined. FIG. 5 illustrates the forming of the pattern using the Voronoi diagram generator.

In the exemplary embodiment of the present invention, the pattern that is obtained from the Voronoi diagram generator may be used by regularly or irregularly positioning the generator.

Even in the case where the entire pattern is formed in a boundary form of figures constituting the Voronoi diagram, when the Voronoi diagram generator is generated, regularity and irregularity may be appropriately harmonized. For example, after the area having a predetermined size is set as the basic unit in the area in which the pattern is provided, the dots are generated so that the distribution of dots in the basic unit has the irregularity, thus manufacturing the Voronoi pattern. If the above method is used, the visibility can be compensated by preventing the localization of the distribution of pattern lines on any one point.

As described above, it is possible to control the number per unit area of the Voronoi diagram generator in order to make the opening ratio of the pattern constant in the unit area for the uniform visibility of the heating element. In this case, when the number per unit area of the Voronoi diagram generators is uniformly controlled, it is preferable that the unit area is 10 $cm^2$ or less. The number per unit area of the Voronoi diagram generator is preferably 10 to 2,500/$cm^2$ and more preferably 10 to 2,000/$cm^2$.

Among the figures that form the pattern in the unit area, at least one has preferably the different shape from the remaining figures.

According to another exemplary embodiment of the present invention, the entire pattern may be a boundary form of the figures that are formed of at least one triangle forming the Delaunay pattern. In detail, the form of the pattern may be a boundary of the triangles that form the Delaunay pattern, a boundary form of the figures formed of at least two triangles that form the Delaunay pattern or a combination thereof.

Figure 6:
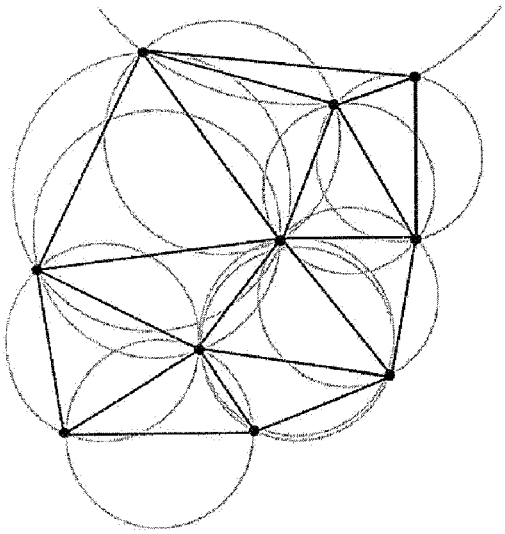

The distribution of the entire pattern may be made uniform and the side effects due to diffraction and interference of light may be minimized by forming the pattern in the boundary of the figures that are formed of at least one triangle that forms the Delaunay pattern. The Delaunay pattern is a pattern that is formed by disposing the Delaunay pattern generator dots in the area in which the pattern will be filled and drawing a triangle by connecting three dots therearound so that when the circumcircle that includes all apexes of the triangle is drawn, there is no other dot in the circle. In order to form the pattern, Delaunay triangulation and circulation may be repeated on the basis of the Delaunay pattern generator. The Delaunay triangulation may be performed in such a way that a thin triangle is avoided by maximizing the minimum angle of all angles of the triangle. The concept of the Delaunay pattern was proposed by Boris Delaunay in 1934. An example of forming the Delaunay pattern is shown in FIG. 6.

The pattern of the boundary of the figures that are formed of at least one triangle that forms the Delaunay pattern may use the pattern that is obtained from the generator by regularly or irregularly positioning the Delaunay pattern generator. In the exemplary embodiment of the present invention, in the case of when the pattern is formed by using the Delaunay pattern generator, there is an advantage in that the complex pattern form that can minimize the side effects due to the diffraction and interference of light can be easily determined.

In the case where the pattern is formed in the boundary form of the figures that are formed of at least one triangle that forms the Delaunay pattern, when the Delaunay pattern generator is generated, regularity and irregularity may be appropriately harmonized. For example, an irregular and uniform standard dot is generated in the area in which the pattern is provided. In this case, the irregularity means that the distances between the dots are not constant, and the uniformity means that the numbers of the dots that are included per unit area are the same as each other. If the above method is used, visibility can be compensated by preventing the localization of the distribution of lines at any one point.

As described above, in the case where the opening ratio of the pattern is made constant in the unit area for the uniform heat emitting and visibility of the heating element, it is preferable to control the number per unit area of the Delaunay pattern generator. In this case, when the number per unit area of the Delaunay pattern generator is uniformly controlled, it is preferable that the unit area is 10 $cm^2$ or less. The number per unit area of the Delaunay pattern generator is preferably 10 to 2,500/$cm^2$ and more preferably 10 to 2,000/$cm^2$.

Among the figures that form the pattern in the unit area, at least one has preferably the different shape from the remaining figures.

In the exemplary embodiment of the present invention, obstruction of a field of vision by the pattern may be minimized by constituting the entire pattern including the heat emitting pattern line and non-heat emitting pattern line by the above Voronoi pattern or Delaunay pattern. At the same time, uniform heat emitting may be implemented even though the intervals between the bus bars are different from each other by constituting a portion of the Voronoi pattern or Delaunay pattern by the heat emitting pattern line and constituting the remains by the non-heat emitting pattern line. For example, as illustrated in FIG. 4, in the area in which the interval between the bus bars is large, like FIG. 4A, an extension of a horizontal axis may be short, and in the area in which the interval between the bus bars is small, like FIG. 4B, the extension of the horizontal axis may be long. In this case, as described above, the lengths of the heat emitting pattern lines in the areas may be the same as each other by making the numbers of apexes of the heat emitting pattern lines identical with each other, such that uniform heat emitting may be implemented.

In the exemplary embodiment of the present invention, the bus bar may be formed simultaneously with the heat emitting pattern line or non-heat emitting pattern line, and may be formed by using a printing method the same as or different from the method used for the above pattern line. For example, after the pattern line is formed by using the offset printing method, the bus bar may be formed through the screen printing. In this case, the thickness of the bus bar is appropriately 1 to 100 μm and preferably 10 to 5 μm. If it is less than 1 μm, since the contact resistance between the pattern line and the bus bar is increased, local heat emitting may be performed at the contact portion, and if it is more than 100 μm, the cost of the electrode material is increased. The connection between the bus bar and power supply may be performed through soldering and physical contact with the structure that has good conductive heat emitting.

In the exemplary embodiment of the present invention, two bus bars to which opposite voltages are applied may be disposed at opposite positions as illustrated in FIG. 2, or may be disposed at the same direction position at one side of the heating element as shown in FIG. 3. For example, in the case where the heating element according to the exemplary embodiment of the present invention is applied to glass for a vehicle, it is preferable that the bus bar is disposed at the lower portion based on where the heating element is mounted in the vehicle.

The minimum interval between the bus bars disposed at opposite positions may be 4 cm or more, and preferably 10 cm or more. The bus bar may be disposed on the same line of the lower end portion of the heating element, and in this case, the interval between the bus bars may be maintained at 2 mm or more, and preferably 5 mm or more.

In order to conceal the pattern line and the bus bar, the black pattern may be formed. The black pattern may be printed by using the paste that includes cobalt oxides. In this case, it is appropriate that as the printing method, the screen printing is used and its thickness is 10 to 100 μm. The pattern line and the bus bar may be formed before or after the black pattern is formed.

In the exemplary embodiment of the present invention, in the case where the printing method is used, the heat emitting pattern line and non-heat emitting pattern line may be designed by a design of cliché, and in the case where the photolithography method is used, the lines may be designed by a design of a photomask.

The heating element according to the exemplary embodiment of the present invention may include an additional transparent substrate that is provided on a surface on which the heat emitting pattern line and non-heat emitting pattern line of the transparent substrate are provided. When the additional transparent substrate is attached, an adhesive film may be inserted between the pattern line and the additional transparent substrate. In the attaching process, the temperature and pressure may be controlled.

In one detailed embodiment, the adhesive film is inserted between the transparent substrate on which the pattern line is formed and the additional transparent substrate, and they are put into the vacuum bag, and reduced in pressure while temperature is increased or increased in temperature by using the hot roll, thus removing the air, thereby accomplishing the first attachment. In this case, the pressure, temperature and time may vary according to the kind of the adhesive film, but in general, the temperature may be gradually increased from normal temperature to 100° C. at a pressure of 300 to 700 Torr. In this case, it is preferable that the time is generally 1 hour or less. The preliminarily attached layered structure that is first attached is subjected to a second attachment process by the autoclaving process where the temperature is increased while the pressure is added in the autoclave. The second attachment varies according to the kind of the adhesive film, but it is preferable that after the attachment is performed at the pressure of 140 bar or more and the temperature in the range of 130 to 150° C. for 1 to 3 hours, and preferably about 2 hours, it is slowly cooled.

In another detailed embodiment, the method for attaching them through one step by using the vacuum laminator device unlike the above two-step attachment process may be used. The attachment may be performed by increasing the temperature step by step to 80 to 150° C. and slowly cooling them so that the pressure is reduced (~5 mbar) until the temperature is 100° C. and thereafter the pressure is added (~1,000 mbar).

Any material that has an adhesive strength and is transparent after attaching may be used as the material of the adhesive film. For example, a PVB film, an EVA film, a PU film and the like may be used, but the adhesive film is not limited thereto. The adhesive film is not particularly limited, but it is preferable that its thickness is in the range of 100 μm to 800 82 m.

The heating element according to the exemplary embodiment of the present invention may be connected to the power supply for heat emitting, and in this case, the heat emitting amount is 100 to 700 W per $m^2$, and preferably 200 to 300 W per $m^2$. Since the heating element according to the exemplary embodiment of the present invention has excellent heat emitting performance even at a low voltage, for example, 30 V or less, and preferably 20 V or less, it may be usefully used in vehicles and the like. Resistance in the heating element is 1 ohm/square or less, and preferably 0.5 ohm/square or less.

The heating element according to the exemplary embodiment of the present invention may have a shape of curved surface.

In the heating element according to the exemplary embodiment of the present invention, it is preferable that the opening ratio of the entire pattern, that is, the area ratio of the transparent substrate that is not covered with the pattern is 65% or more. The heating element according to the exemplary embodiment of the present invention has an excellent heat emitting property where the temperature may be increased while an opening ratio is 65% or more and the temperature deviation within 5 min after the heat emitting operation is maintained at 10% or less.

The heating element according to the exemplary embodiment of the present invention may be applied to glass that is used for various transport means such as vehicles, ships, railroads, high-speed railroads, and airplanes, houses or other buildings. In particular, since the heating element according to the exemplary embodiment of the present invention has the uniform heat emitting property and does not obstruct a field of vision, unlike the known technologies, the heating element may be applied to front glasses or side glasses of transporting means such as a vehicle. Even in the case where the heating element according to the exemplary embodiment of the present invention is particularly applied to the side glass of the transporting means, uniform heat emitting and a concealment property of the pattern may be exhibited.

Yet another exemplary embodiment of the present invention provides a heating element which includes a transparent substrate, a bus bar, a power supply connected to the bus bar, and a heat emitting pattern line provided on the transparent substrate and electrically connected to the bus bar, wherein when an area in which the heat emitting pattern line is provided is divided into two or more partitions, lengths of the heat emitting pattern lines connected to the bus bars in the partitions are the same as each other. The relating contents may be selected from the above description.

Another exemplary embodiment of the present invention provides a method for manufacturing a heating element, which includes simultaneously or separately forming a bus bar, a heat emitting pattern line electrically connected to the bus bar, and a non-heat emitting pattern line not electrically connected to the bus bar on a transparent substrate. The transparent substrate, the bus bar, the hot wire, and the like may be selected from the above materials and methods.

In the case where the area in which the heat emitting pattern line is provided is divided into two or more partitions so that the lengths of the heat emitting pattern lines in the partitions are the same as each other, uniform heat emitting may occur with the same length of the heat emitting line in the partitions, the heat emitting between the partitions may uniformly occur, or the heat emitting between the partitions may intentionally occur differently. In detail, a portion of the area in the entire heat emitting area may be intentionally partitioned into a high level of heat emitting area and a low level of heat emitting area by changing the interval between the partitions and the length of the heat emitting line between the partitions. For example, when the heating element is applied to the side glasses of the vehicle, when the partition of the area adjacent to a side mirror is designed as the heat emitting area having a high level as compared to the partition of the other areas, there is a merit in that visibility of a driver can be rapidly ensured with respect to the area of the side mirror at which a field of vision should be primarily ensured.

Mode for Invention

The invention will be described in more detail in the following Examples. However, the following Examples are set forth to illustrate but are not to be construed to limit the present invention.

EXAMPLE 1

The heat emitting attachment glass was manufactured by inserting the heat emitting film in order to provide the heat emitting function to the side glass for the vehicle. The heat emitting pattern used in the film according to the exemplary embodiment of the present invention was on the basis of the Voronoi pattern, the bus bar was formed in a manner illustrated in FIG. 1, and the designing was performed so that the average pitch of the pattern corresponding to area B was 2 mm in FIG. 1. The heat emitting pattern line was formed by designing the pattern by controlling the pitch W of the pattern of area A from 2 to 16 mm according to the distance L between the bus bars by Equation 1 in order to satisfy the uniform heat emitting. With respect to the portion in which the pitch of the pattern was wider than 2 mm, the visually uniform pattern line was formed by overlapping the non-heat emitting pattern line with the known Voronoi pattern. When the heat emitting attachment glass manufactured by this manner was applied with the vehicle voltage of 12 V, the heating value was about 700 W/m$^2$, and the temperature deviation due to heat emitting was about 6%, such that the uniform heat emitting occurred.

COMPARATIVE EXAMPLE 1

The heat emitting attachment glass was manufactured by using the same manner as Example 1, except that the non-heat emitting pattern line was not inserted. The same heat emitting characteristic was exhibited, but since an area in which the pattern was visually dense or sparse was easily recognized by the eyes by the non-uniform distribution of the pattern, a problem of obstructing a field of vision occurred.

The invention claimed is:

1. A heating element, comprising:

a transparent substrate;

two bus bars;

a plurality of heat emitting pattern lines provided on an upper-side of the transparent substrate and electrically connected to the bus bar, wherein at least one of the plurality of heat emitting pattern lines does not intersect with adjacent hear emitting pattern lines;

a plurality non-heat emitting pattern lines provided on an upper-side of the transparent substrate and not electrically connected to the bus bars; and a plurality of heating units, each comprising an area bound by two adjacent heat emitting pattern lines and the bus bars, wherein the bus bars and the plurality of heat emitting pattern lines are positioned such that if there is a voltage difference between the bus bars, each heating unit has substantially the same value for the following Equation 1:

$$\frac{V\times I}{L\times W}=\frac{V^2\times(1/R)}{L\times W}=\frac{V^2}{R\times L\times W}=\frac{V^2}{aL\times L\times W}, \quad \text{[Equation 1]}$$

where W is a unit width, defined as an interval between a first heat emitting pattern line and an adiacent heat emitting pattern line, V is the voltage difference between the bus bars, I is a current applied to the first heat emitting pattern line, R is a resistance of the first heat emitting pattern line, L is a length of the first heat emitting pattern line, and a is a proportional constant value; and wherein a line width of the heat emitting pattern line and the non-heat emitting pattern line is 100 μm or less, and wherein at least one non-heat emitting pattern line is positioned within at least one heating unit of the plurality of heating units.

2. The heating element according to claim 1, wherein the transparent substrate is a plastic film, a plastic substrate or a glass substrate.

3. The heating element according to claim 1, wherein lengths of the heat emitting pattern lines connected to the bus bar in the heating units are equal.

4. A method for manufacturing the heating element according to claim 1, comprising:

simultaneously or separately forming two bus bars, the plurality of heat emitting pattern lines-electrically connected to the bus bars, and the plurality of non-heat emitting pattern lines not electrically connected to the bus bars on a transparent substrate.

5. The heating element according to claim 1, wherein the heat emitting pattern lines and the non-heat emitting pattern lines are positioned in a Voronoi pattern or a Delaunay pattern.

6. A heating element, comprising:

a transparent substrate;

two bus bars;

a plurality of heat emitting pattern line provided on an upper-side of the transparent substrate and electrically connected to the bus bars, wherein at least one of the plurality of heat emitting pattern lines does not intersect with adjacent heat emitting pattern lines;

a plurality of non-heat emitting pattern lines provided on an upper-side of the transparent substrate and not electrically connected to the bus bars; and a plurality of heating units, each comprising an area bound by two adjacent heat emitting pattern lines and the bus bars, wherein the bus bars and the plurality of heat emitting pattern lines are positioned such that if there is a voltage difference between the bus bars, each heating unit has substantially the same value for the following Equation 1:

$$\frac{V\times I}{L\times W}=\frac{V^2\times(1/R)}{L\times W}=\frac{V^2}{R\times L\times W}=\frac{V^2}{aL\times L\times W} \quad \text{[Equation 1]}$$

where W is a unit width, defined as an interval between a first heat emitting pattern line and an adiacent heat emitting pattern line, V is the voltage difference between the bus bars, I is a current applied to the first heat emitting pattern line, R is a resistance of the first heat emitting pattern line, L is a length of the first heat emitting pattern line, and a is a proportional constant value; and wherein lengths of the heat emitting pattern lines connected to the bus bars in the heating units are equal, wherein a line width of the heat emitting pattern line and the non-heat emitting pattern line is 100 μm or less, and wherein at least one non-heat emitting pattern line is positioned within at least one heating unit of the plurality of heating units.

7. A heating element, comprising:

a transparent substrate;

a bus bar;

at least two heat emitting pattern lines provided on an upper side of the transparent substrate and electrically connected to the bus bar; and at least two non-heat emitting pattern lines provided on an upper side of the transparent substrate and not electrically connected to the bus bar, and wherein at least one non-heat emitting pattern line is positioned between two heat emitting pattern lines; and wherein at least one of the plurality of heat emitting pattern lines does not intersect with adjacent heat emitting pattern lines.

8. The heating element of claim 7, wherein the bus bar is disposed in a lower end of the transparent substrate, and wherein each heat emitting pattern line has the same length, thickness, and height, and each heat emitting pattern line is comprised of the same material.

* * * * *